US006604674B1

(12) United States Patent
Bowman

(10) Patent No.: US 6,604,674 B1
(45) Date of Patent: Aug. 12, 2003

(54) GIFT WRAPPING

(75) Inventor: Linden H. Bowman, Ellicott City, MD (US)

(73) Assignee: The Lindy Bowman Co., Ellicott City, MD (US)

( * ) Notice: Subject to any disclaimer, the term of this patent is extended or adjusted under 35 U.S.C. 154(b) by 0 days.

(21) Appl. No.: 10/097,520

(22) Filed: Mar. 15, 2002

(51) Int. Cl.[7] ..... B65D 25/34
(52) U.S. Cl. ..... 229/116.5; 229/87.19
(58) Field of Search ..... 229/87.18, 87.19, 229/116.5

(56) References Cited

U.S. PATENT DOCUMENTS

| | | | | |
|---|---|---|---|---|
| 3,366,313 A | | 1/1968 | Culberg et al. | |
| 3,391,856 A | * | 7/1968 | Siegler | 229/87.19 |
| 3,658,240 A | | 4/1972 | Stoll | |
| 3,790,069 A | | 2/1974 | Straccamore | |
| 4,571,232 A | | 2/1986 | Diehl | |
| 4,712,726 A | | 12/1987 | Fonas | |
| 4,967,952 A | | 11/1990 | Roessiger | |
| 5,033,668 A | | 7/1991 | Cohen | |
| 5,065,935 A | | 11/1991 | Mancel | |
| 5,100,051 A | | 3/1992 | Trigial et al. | |
| 5,156,584 A | | 10/1992 | Cohen et al. | |
| 5,207,376 A | | 5/1993 | Cohen et al. | |
| 5,294,040 A | | 3/1994 | Cohen et al. | |
| 5,337,943 A | | 8/1994 | Hendren | |
| 5,493,843 A | * | 2/1996 | Weder | 53/399 |
| 5,542,597 A | * | 8/1996 | Richards | 229/116.5 |
| 5,556,025 A | | 9/1996 | Sloan | |
| 5,740,959 A | | 4/1998 | Savage | |
| 5,979,651 A | | 11/1999 | Betts | |
| 6,187,403 B1 | | 2/2001 | Richardson | |

* cited by examiner

*Primary Examiner*—Jes F. Pascua
(74) *Attorney, Agent, or Firm*—Cahn & Samuels, LLP

(57) ABSTRACT

Provided herein is a combination folding gift box-sheet wrap combination that includes measured, pre-scored, indicia-bearing wrapping dimensionally corresponding to the companion gift box where the sheet wrap permits repeatable and consistent wrapping and even when including non-repeating design element.

9 Claims, 5 Drawing Sheets

GIFT WRAPPING

I. FIELD OF THE INVENTION

The present invention relates to improvements gift wrapping and more particularly, to gift wrapping combinations that provide for efficient and attractive gift wrapping by an individual by providing a folding gift cardboard box of specific dimensions with coordinated, pre-formed, pre-taped, pre-marked gift wrap corresponding to the folding box dimensions.

II. BACKGROUND OF THE INVENTION

Typically a gift giver selects a decorative gift wrap that is used to cover a product, box, or other container for the dual purpose of concealing the content and providing a decorative/festive appearance. To achieve a neatly presented gift wrapped package requires skill, discipline, and patience, qualities rarer in some persons than others. Although pre-packaged pre-decorated gift bags and gift box assemblies are now relatively commonplace, some gift givers prefer to provide a personal touch to the gift being given. A personal touch/effort by the gift giver is evidenced by personal hand-wrapping of a gift, a task that is infinitely more difficult for some than others.

For the "wrapping challenged" the task of wrapping a pre-formed box of uniform dimensions still requires wrapping which can provide a less desirable appearance due to wrapping technique flaws.

Furthermore, the task of wrapping a box typically proves time consuming (selecting paper, sizing, cutting, folding and taping) and somewhat wasteful of resources (paper, tape, etc.). In times of high volume, gift purchasing, the prospect of taking the purchases home to wrap them adds to the stress of an already hectic shopping experience. To some challenged gift givers, the combination is almost unbearable.

Alternatives have appeared, for example, at peak gift giving times, e.g., the holiday season, a gift purchaser may turn for help to an available gift-wrap service. This act, itself, may prove to be a challenge as the consumer/gift giver must contend with and negotiate long lines.

The prior art includes several different artifices which address the above described problems in different ways. For example, U.S. Pat. No. 3,366,313 (Culberg et al) discloses a pre-cut and pre-creased gift wrap including pressure sensitive tape disposed selectively along the edges. The stated purpose of the invention to expedite wrapping and produce a wrapped package with an improved appearance.

Another approach is taken by Stoll in U.S. Pat. No. 3,658,240 in which he describes a pre-formed, flattened gift wrap with an adhesive strip correspondingly dimensionally to a complementary gift box, followed sealing of the sleeve end yields a fully gift wrapped box. A stated objective of this disclosure is to minimize storage space and to permit stacking of the package wrapping.

In U.S. Pat. No. 3,790,069, Straccamore discloses a collapsed, pre-wrapped gift wrap and box combination. Hendren, in U.S. Pat. No. 5,337,943 discloses a variation of pre-creased, pre-cut gift wrap for complementary gift boxes of the type described in Straccamore. Hendren's sheet of wrap incorporates three generally parallel adhesive strips disposed longitudinally on the inside face of the sheet of gift wrap. The sheet of gift wrap also incorporates pre-scribed fold lines.

Diehl sets out a further example in U.S. Pat. No. 4,571,232. There he provides an example of foldable box incorporating a secured, preformed, inner liner that automatically extends upon erection of the box. Savage (U.S. Pat. No. 5,740,959) depicts a variant of more recent vintage, in the pre-cut, pre-creased gift wrap genre.

The final prior patent publication discussed here is Sloan (U.S. Pat. No. 5,556,025) in which a gift wrapping sleeve having one end pre-sealed is disclosed where following insertion of an associative gift box ("hexahedronally shaped article"), the open end is sealed.

The prior art does not show or discuss combining in a single flat package, an erectable flat-folded cardboard folding gift box with a sheet of flat, foldable, dimensionally coordinated gift wrap.

A matter not contemplated or addressed by the above-mentioned prior art concerns to the presentation of the exterior artwork. The prior art shows and contemplates the use of conventional wrapping material, e.g., that displaying relatively small repeating patterns. Relatively small, repeating pattern of indicia serve to mask wrapping errors while presenting a generally attractive appearance. It is not desirable under the prior art to provide pre-cut gift wrap exhibiting large or a single item because the larger the subject matter of the design relative to the package, the less forgiving the visual impression of the finished product in respect to alignment errors and misfolds.

Notwithstanding the usefulness of the above-described adjuncts and methods, a need still exists for a gift wrapping expedient that permits a person to hand wrap a boxed gift in an erectable folding gift box with a virtually mistake-proof box alignment system that properly displays the subject decorative gift wrap where said gift wrap includes pre-scored fold lines, placement guides, and stepwise wrapping instructions. In short, the art needs a gift wrapping combination that permits consistent and attractive results to be obtained.

III. SUMMARY OF THE INVENTION

It is an object of the present invention to provide box gift wrapping kit system that overcomes the problems of the prior art.

It is another object of the invention to provide a pre-packaged gift box wrapping combination with a folding gift box of specific dimensions that minimizes mis-alignment during wrapping.

It is another object of this invention to provide an attractive gift presentation, independent of the wrapping skill level of the gift giver.

Still another object of this invention is to provide a combination of a box to hold a gift with giftwrap of selected design elements that self-align during wrapping when the step by step instructions are followed.

A further object of this invention is to provide an embodiment where a folding gift box and accompanying ornamental gift wrap combination lies flat until used.

It is an object of the present invention to provide a flat packaged, folding gift box with a complementarily dimensioned, sheet of gift wrap for hand wrapping the box and its content where the sheet includes adhesive strips with removable covers to selectively expose the strips upon removal thereof and indicia for proper positioning of the box on the sheet and including pre-printed step-by-step instructions for securing the sheet to the box to provide a gift wrapped package.

It is a further object of this invention to provide a secure enclosure for gifts, while maintaining a decorative hand-wrapped presentation.

It is another object of this invention to provide a gift-wrapping alternative for a gift that, at once, provides maximum aesthetic appeal and decorative presentation with a minimum of effort, waste, and complexity.

These and other objects of the invention are satisfied by a combination gift box and gift wrap comprising:

a box container, having an upper section, said upper section being formed by a generally planar upper panel of selected width and length bordered by depending side walls of a select length defining the depth of the gift box, said box having a lower section being formed by a generally planar lower panel of selected width and length bordered by ascending side walls of a select length corresponding to the select length of said dependant side walls and adapted to nest within the upper section upon assembly;

a generally rectangular, flat sheet of wrapping material for wrapping said box container, said wrapping material having an operational surface adapted to confront the box container, an obverse decorative surface and an perimeter defined by a first, second, third, and fourth edges, said first and third edges being spaced apart by a distance equal to the length of the second and fourth edges where said first and third edges are parallel to one another and second and fourth edges are parallel to one another, respectively;

said operational surface of said flat sheet having printed thereon gift box alignment indicia, a first and second longitudinally disposed marked fold lines disposed interiorly of the first and third edge by a distance corresponding to the dependant side walls of the box container, a third and fourth laterally disposed marked fold lines disposed perpendicularly relative to the first and second fold lines where the operational surface bordered by the first, second, third, and fourth fold lines dimensionally conforms planar upper panel of the box container, said operational surface further including fifth and sixth marked fold lines, spaced parallel to and respectively spaced from said third and fourth fold lines by a distance corresponding to the length of the dependant side walls of the box container, said operational surface further including at least one selectively positioned and activatable sealing adhesive member disposed proximate to third edge between said first and second fold lines, and at least one selectively positioned activatable sealing adhesive member being disposed proximate to each of the first and second edges between said third and fourth fold lines, said operational surface including printed step-by-step instructions thereon at selected locations so that the instruction for the next step remains visible to the user until the wrapping is completed.

Other objects of the invention are satisfied by a method of forming a gift wrapped gift box employing the combination according to claim 1 comprising the steps of:

preparing a gift box to receive an item and placing the item in the gift box;

placing the sheet of wrapping material on a flat surface with its decorative obverse side facing down and its operational side facing up;

placing the upper panel of the gift box on the operational side of the wrapping material in the area bordered and defined by the first, second, third and fourth fold lines;

folding the wrapping material about the third and fifth fold lines and then the fourth and sixth fold lines to where the fourth edge is positioned over the lower panel of the gift box;

activating the activatable sealing adhesive member proximate to the third edge and adhereing the third edge to the gift box;

tucking in the section of wrapping material defined by the first fold line and disposed between the third and fifth fold lines and the fourth and sixth fold lines respectively;

tucking in the section of wrapping material defined by the second fold line and disposed between the third and fifth fold lines and the fourth and sixth fold lines respectively;

activating the activatable sealing adhesive member proximate to the first edge, folding the first edge over the wrapping material disposed along the wall of the gift box to confront and bind to underlying wrapping material; and activating the activatable sealing adhesive member proximate to the second edge, folding the second edge over the wrapping material disposed along the wall of the gift up box to confront and bind to underlying wrapping material.

This invention provides an easily vendible, space minimizing, easily used, relatively inexpensive gift wrapping kit combination preferably including a collapsed folding gift box with a rectangular, specifically-sized, prescored, partially pre-folded, sheet of gift wrap having a decorative surface and an oppositely facing operational surface including pre-printed instructional and placement indicia. The invention also permits the use of a decorative surface composed of non-repeating artwork. In other words, the invention allows for gift wrap featuring an artistically rendered single item (snowman, birthday cake, animal, etc.) that properly presented on the surface corresponding to the upper surface of the underlying box. Uniquely, the paper may also feature side borders/panels corresponding to the depending box edges where the borders include a coordinated/complementary subject matter. Likewise, non-random, non-repeating subject matter of the decorative gift wrap may provide a thematic presentation on surface covering the bottom of the box proper affixation to the underlying box.

As used herein "substantially," "generally," and other words of degree are relative modifiers intended to indicate permissible variation from the characteristic so modified. It is not intended to be limited to the absolute value or characteristic which it modifies but rather possessing more of the physical or functional characteristic than its opposite, and preferably, approaching or approximating such a physical or functional characteristic.

In the following description, reference is made to the accompanying drawing, which is shown by way of illustration to the specific embodiments in which the invention may be practiced. The following illustrated embodiments are described in sufficient detail to enable those skilled in the art to practice the invention. It is to be understood that other embodiments may be utilized and that structural changes based on presently known structural and/or functional equivalents may be made without departing from the scope of the invention.

IV. BRIEF DESCRIPTION OF THE DRAWINGS

V. DESCRIPTION OF A PREFERRED EMBODIMENT

Figure 1:
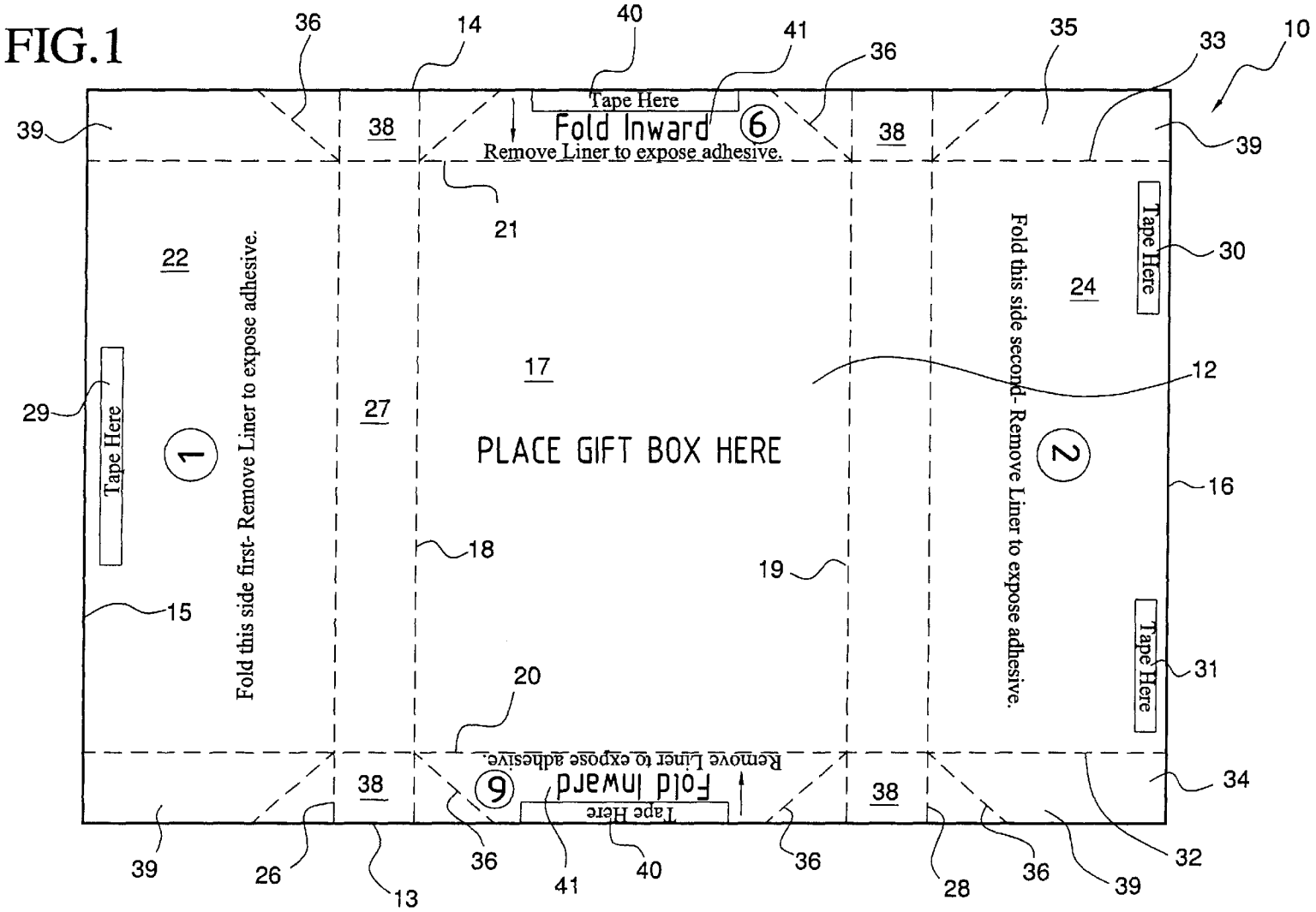
FIG. 1 is a plan view of the operational surface of the invention.
Figure 2:
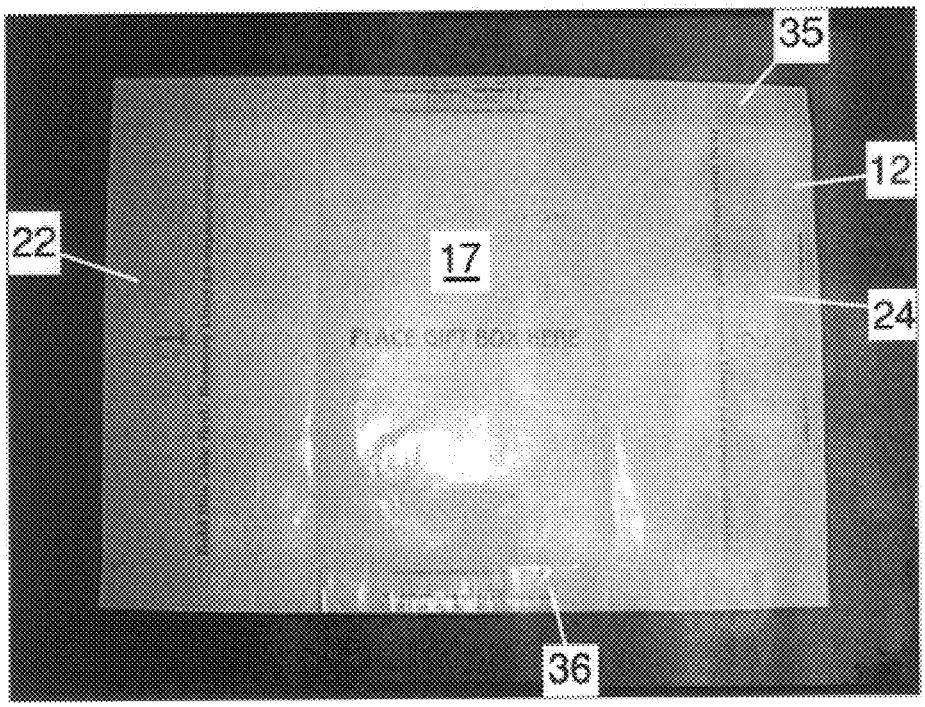
FIG. 2 is a photographic representation of the operational surface of the invention.
Figure 4:
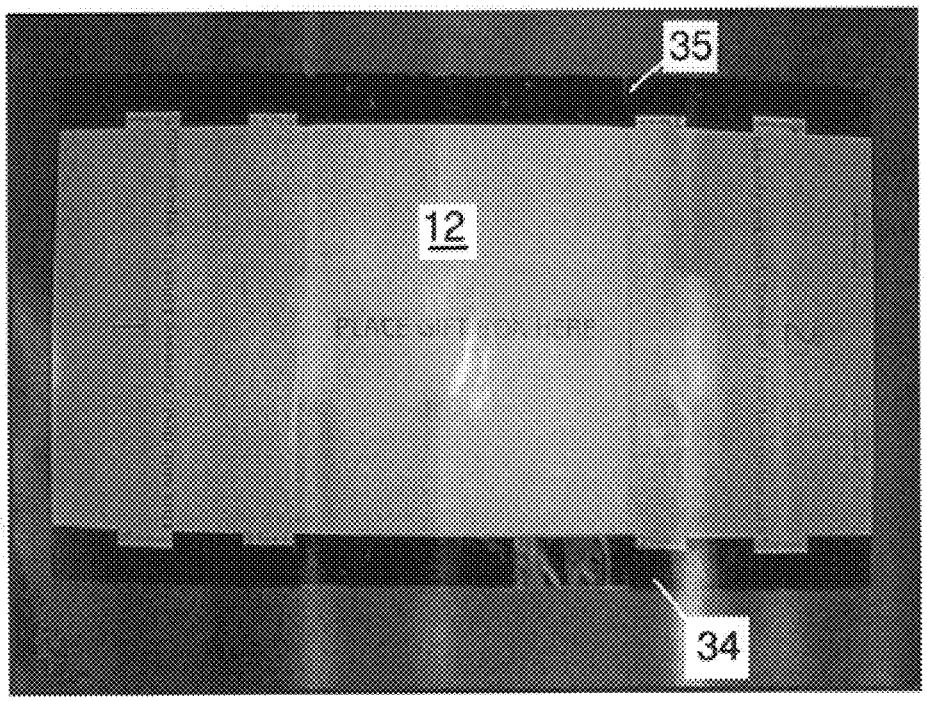
FIG. 4 is a photographic representation of the operational surface of the invention with the longitudinal edges folded over.
Figure 3:
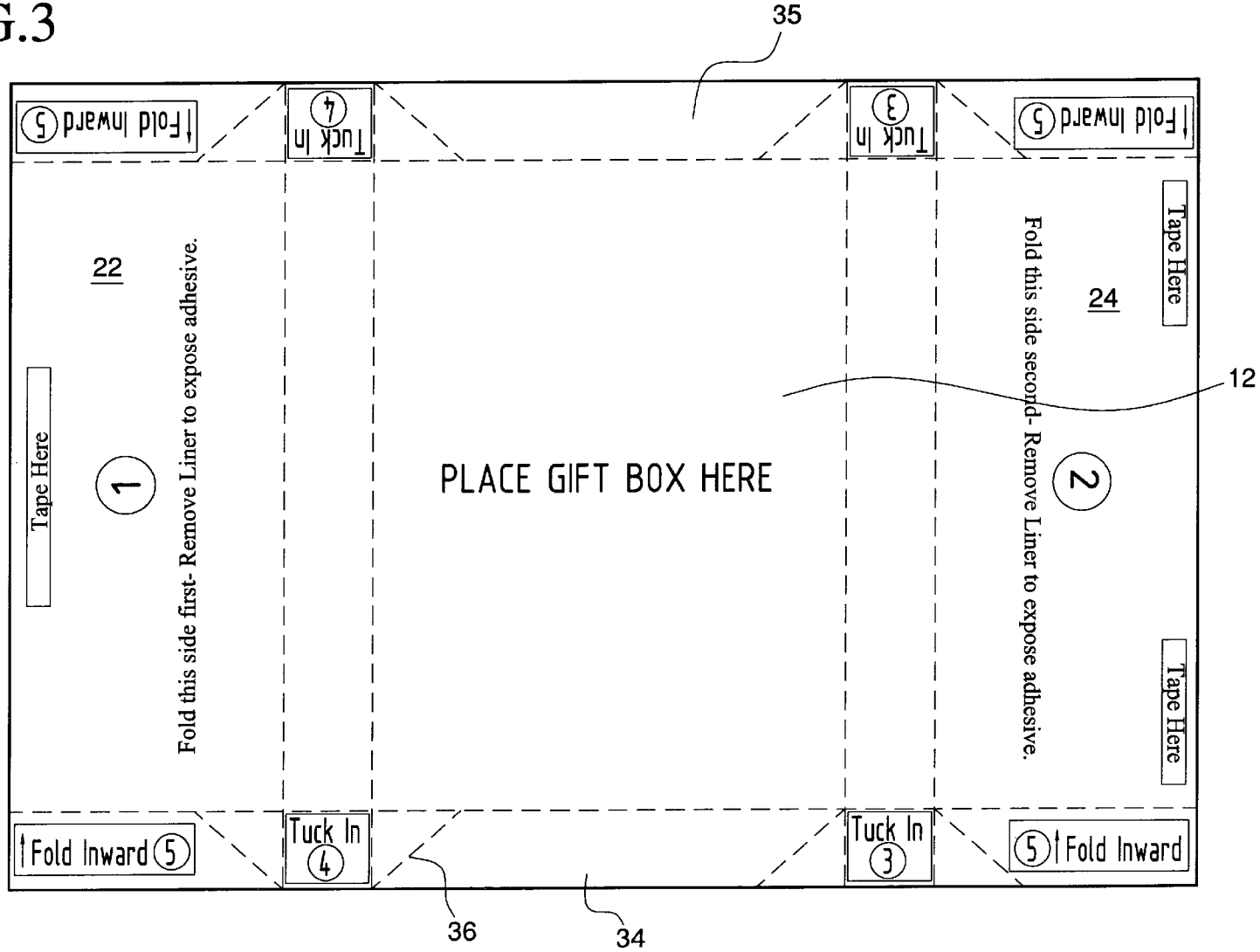
FIG. 3 is a plan view of the operational surface of the invention with the longitudinal edges folded over.
Figure 5:
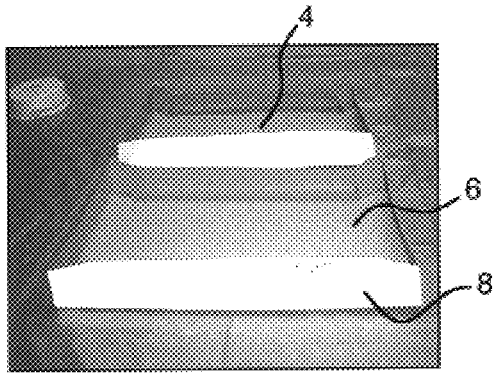
FIG. 5 is a photographic representation of a folding gift box for use in connection with the invention.
Figure 6:
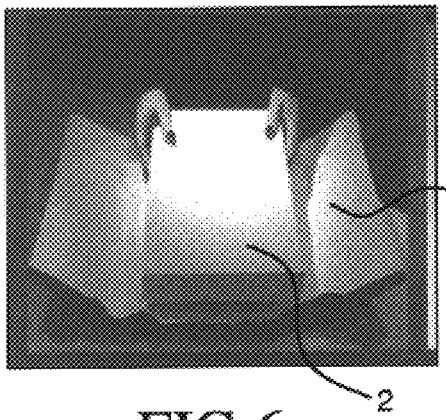
FIG. 6 is a photographic representation of an initial step associated with the use of the invention.
Figure 7:
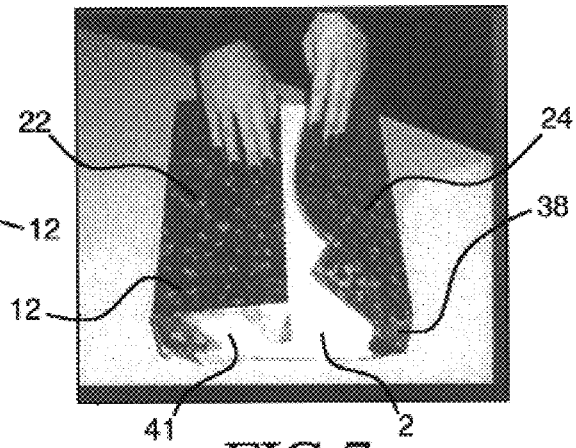
FIG. 7 is a photographic representation of a subsequent step associated with the use of the invention.
Figure 8:
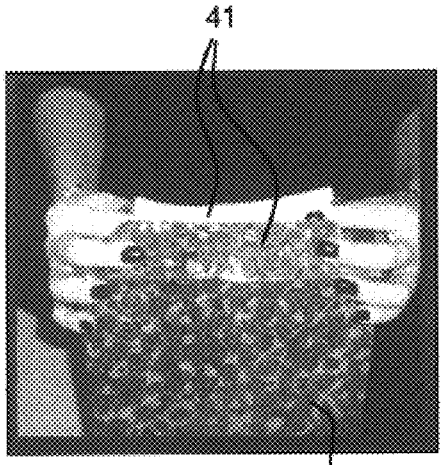
FIG. 8 is a photographic representation of a further step associated with the use of the invention.
Figure 9:
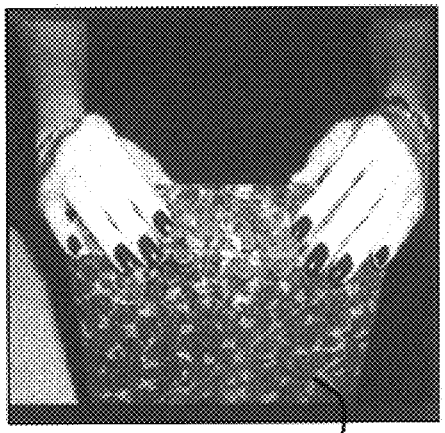
FIG. 9 is a photographic representation of a final sealing step associated with the use of the invention.

The invention herein is directed to a combination and method for using a combination of a gift box with prefabricated, pre-cut, pre-scored and pre-taped wrapping material, e.g., gift paper, including box alignment and instructional indicia. The wrapping sheet 10 according to this invention includes selected decorative/design elements printed or formed on its observe surface (See FIGS. 7–11). The illustrated embodiment depicts a folding gift box (See FIGS. 5–6). The folding gift box typically is formed form 350 to 450 gram cardboard but may be of a heavier weight, if desired. Of course, the invention is not limited to a folding gift box but may involve wrapping of any conventional gift box, e.g., a rigid setup box and the like.

Briefly referring to the depicted folding gift box it is of selected dimensions and packaged with the companion wrapping material in a flat package. The gift box 2 comprises complementary top section 4 and bottom section 6 each with side walls 8. The height width and depth of the box dictate the structure of the sheet wrap 10.

Referring now, in particular, to FIGS. 1 through 4, there is depicted in plan form and photographically, the operational face 12 (working surface) of a decorative wrapping sheet 10 in accordance with an embodiment of the invention.

The rectangular sheet 10 is divided into a plurality of sectors defined by intersecting pre-marked lines and bearing identifying indicia 11. The lines preferably combine visible markings combined with pre-scoring so as to facilitate use of the invention. The operational surface 12 of the sheet 10 is adapted to confront the underlying box container, and defines a rectangular perimeter with first elongated edge 13 and third elongated edge 14 and second lateral edge 15 and fourth lateral edge 16. The width of the sheet 10 corresponds to the distance between the first and third edges and the length of the sheet corresponds to the distance between the second and fourth edges. As depicted, in the illustrated embodiment the first and third edges are parallel to one another and second and fourth edges are parallel to one another, respectively. Notably, although the invention is illustrated in rectangular format and as gift wrap, it is not intended to be confined solely to rectangular gift wrapping and may embrace other sheet like materials (polymers, fabrics, etc.) as well as polyhedral or curved package configurations without departing from the inventive concepts described herein.

The sheet 10 includes a generally centrally disposed gift box receiving zone 17 of a select length and width substantially corresponding to that of the companion gift box 2. The zone 17 is bounded by longitudinal fold/score lines 18 and 19 and lateral fold/score lines 20 and 21 which define the edges of the zone 17. A first flap 22 is bounded by the first edge 15, the score line 18, and longitudinal edges 13 and 14. A second flap 24 is defined by the fourth edge 16 and the score line 19. The first flap 22 features a score line 26 disposed between score line 18 and edge 15 which is generally parallel to score line 18 and separated therefrom by a distance generally corresponding to the length of the gift box sides 8. In this manner, upon folding the flap 22 over the box, a strip 27 corresponding to the sides of the underlying box 2. Likewise, the second flap 24 features an intermediate score line 28 disposed between edge 16 and score line 19, being parallel thereto and being separated by a distance corresponding to the depth of the gift box (sides 8).

Disposed proximate to the edge 15 is a strip 29 of conventional pressure sensitive sealing tape that includes a removable protective cover. When ready for use, in accordance with the use pre-printed instructions located on the flap 22, the protective cover is removed from the tape strip 29, the flap folded over the pre-positioned gift box (see FIG. 6), the strip is brought into a confronting relationship with the and pressure applied thereto affix the flap to underlying box.

The user then removes the protective covers from the sealing tape strips 30 and 31, located proximate to the edge 16, and folds the second flap 24 along lines 19 and 28 so as to overly the edge 15 and a portion of the first flap now affixed to the box. (See FIG. 7).

At this point the sheet 10 is in the form of a sleeve overlying the gift box. The longitudinal edges 13 and 14 project beyond the edge of the underlying box by a to form end flaps where the flaps extend to edges 13 and 14 respectively from fold lines 32 and 33. The central segments of longitudinal fold lines 32 and 33 repectively include segments 20 and 21 which correspond to the width of the underlying gift box. Lines 32 and 33 are pre-scored and preferably for reducing the side of packaging and permitting the packaged kit to have a profile corresponding to collapsed folding gift box dimensions, come pre-folded (See FIGS. 3 and 4) and unfolded before wrapping. The longitudinal strips 34 and 35 are formed between edge 13 and fold line 32 on the one hand, and edge 14 and fold line 33 on the other hand. Each of the strips 34 and 35 include a series diagonal pre-scored and pre-marked fold lines 36 projecting from the fold line 32 to edge 13 and from fold line 33 to edge 14. These lines facilitate tucking the segments 38 onto the side walls of the underlying box to provide for uniform and neat end flap sealing. The strips 34 and 35 constitute the above-mentioned end flaps.

To complete the wrapping process, the segments 38 are first tucked in followed by folding the strip flap segments 39 against the underlying box side. The protective cover over the self-sealing, pressure sensitive tape strips 40 are removed and the intermediate strip segments 41 are folded over and pressed onto the underlying strip flap segments 39. (See FIGS. 8 and 9).

As depicted in FIGS. 1–4, the operational wrap surface includes printed step-by-step instructions. These instructions include both written instructions in any desired language and numerical indicators to indicate the sequence of steps to be followed. In the case of the illustrated embodiment, the instructions are located in a manner whereby instructions for subsequent steps are visible to the wrapper until the package is completed. For example, after the box has been positioned, the users folds over flap 1, removes the tape cover, and presses the tape to the box. Next, as step 2, the second flap is applied as indicated. Step three requires the end segments 38 to be tucked in so as to lie flat against the box. The next step involves folding the flap strip segments over the tucked-in end segments. Finally, after removing the tape protectors, the intermediate strip segments are pressed onto the folded flap strips. The final result is a neatly hand-wrapped package 45 such as that depicted in FIG. 11.

Figure 10:
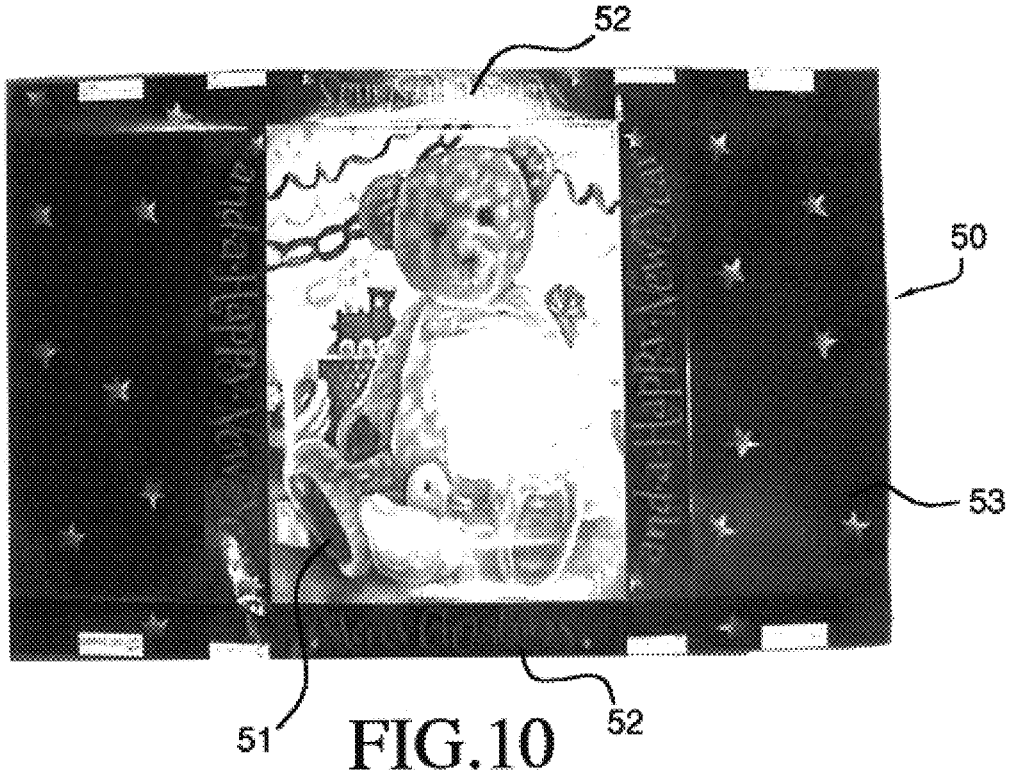
FIG. 10 is a photographic representation of an obverse decorative surface of a gift wrapping sheet in accordance with an embodiment of the invention.
Figure 11:
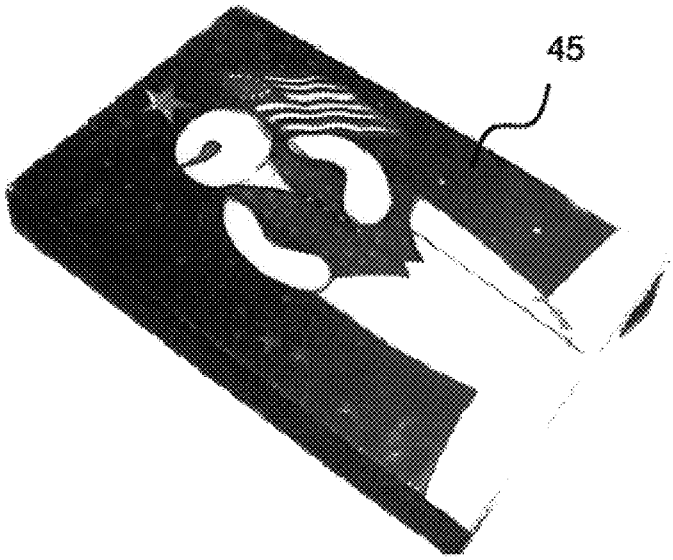
FIG. 11 is a photographic representation of a finished package wrapped in paper with a non-repeating design formed on the obverse decorative surface of the sheet.

Referring briefly to FIG. 10, it represents a wrapping paper sheet 50 that includes a single drawing cover 51 with a border 52 containing indicia (a message, e.g., Happy Holidays) that extend about the box sides. Where the obverse sheet features a single subject drawing, a unique non-repeating border positionally corresponding to the depending box sides, and a third unique design zone adapted for placement over the underlying box bottom.

and decorative elements that overlie the box sides. The flap segments which overly the back of the box provide still another different decorative element 53 to the overall presentation. Consequently, the invention permits a wrapping challenged individual to present personally hand-wrapped gifts in a wide variety of highly decorative, situationally appropriate wrapping that is neat and uniform. Correspondingly, companies may imprint logos/slogans and the like in tasteful and decorative formats.

The invention also contemplates packaging use and sale of single or multiple sheets of the novel wrapping according to the invention independent of the gift box, subject to the sheet(s) being dimensioned so as to conform to standard gift box (folding or rigid) dimensions.

Given the foregoing, it should be apparent that the specifically described embodiments are illustrative and not intended to be limiting. Furthermore, variations and modifications to the invention should now be apparent to a person having ordinary skill in the art. These variations and modifications are intended to fall within the scope and spirit of the invention as defined by the following claims.

I claim:

1. A combination gift box and sheet wrap comprising:

a box container, having an upper section, said upper section being formed by a generally planar upper panel of selected width and length bordered by depending side walls of a select length defining the depth of the gift box, said box having a lower section being formed by a generally planar lower panel of selected width and length bordered by ascending side walls of a select length corresponding to the select length of said dependant side walls and adapted to nest within the upper section upon assembly;

a generally rectangular, flat sheet of wrapping material for wrapping said box container, said wrapping material having an operational surface adapted to confront the box container, an obverse decorative surface and an perimeter defined by a first, second, third, and fourth edges, said first and third edges being spaced apart by a distance equal to the length of the second and fourth edges where said first and third edges are parallel to one another and second and fourth edges are parallel to one another, respectively;

said operational surface of said flat sheet having printed thereon gift box alignment indicia, a first and second longitudinally disposed marked fold lines disposed interiorly of the first and third edge by a distance corresponding to the dependant side walls of the box container, a third and fourth laterally disposed marked fold lines disposed perpendicularly relative to the first and second fold lines where the operational surface bordered by the first, second, third, and fourth fold lines dimensionally conforms planar upper panel of the box container, said operational surface further including fifth and sixth marked fold lines, spaced parallel to and respectively spaced from said third and fourth fold lines by a distance corresponding to the length of the dependant side walls of the box container, said operational surface further including at least one selectively positioned and activatable sealing adhesive member disposed proximate to third edge between said first and second fold lines, and at least one selectively positioned activatable sealing adhesive member being disposed proximate to each of the first and second edges between said third and fourth fold lines, said operational surface including printed step-by-step instructions thereon at selected locations so that the instruction for the next step remains visible to the user until the wrapping is completed.

2. The combination gift box and sheet wrap according to claim 1 further comprising printed instructions disposed on the obverse surface between said first edge and said first fold line and said second edge and said second fold line and where the gift box is a folding gift box.

3. The combination gift box and sheet wrap according to claim 1 where the wrapping material is paper and further comprising a non-repeating single design subject of select dimensions printed on the obverse surface of the gift wrap where the select dimensions of the single design subject matter corresponds to the generally planar upper panel.

4. The combination gift box and sheet wrap according to claim 3 further comprising a border design on the obverse surface coordinating with the single design subject and dimensionally corresponding to areas between said third and fifth and fourth and sixth fold lines.

5. The combination gift box and sheet wrap according to claim 4 further comprising a border design on the obverse surface coordinating with the single design subject and dimensionally corresponding to areas between first fold line and said first edge and said second fold line and said second edge.

6. The combination gift box and sheet wrap according to claim 5 further comprising a selected design printed on the obverse surface coordinating with the single design subject and dimensionally corresponding to areas between said fifth fold line and said third edge and said sixth fold line and said fourth edge.

7. The combination gift box and sheet wrap according to claim 1 further comprising a plurality of diagonally disposed fold lines extending to the first and second edges respectively from where the first and second fold lines intersect the third, fourth, fifth, and sixth fold lines.

8. The combination gift box and sheet wrap according to claim 7 where said marked fold lines are scored to facilitate folding.

9. The method of forming a sheet wrapped gift box employing the combination according to claim 1 comprising the steps of:

preparing a gift box to receive an item and placing the item in the gift box;

placing the sheet of wrapping material on a flat surface with its decorative obverse side facing down and its operational side facing up;

placing the upper panel of the gift box on the operational side of the wrapping material in the area bordered and defined by the first, second, third and fourth fold lines;

folding the wrapping material about the third and fifth fold lines and then the fourth and sixth fold lines to where the fourth edge is positioned over the lower panel of the gift box;

activating the activatable sealing adhesive member proximate to the third edge and adhereing the third edge to the gift box;

tucking in the section of wrapping material defined by the first fold line and disposed between the third and fifth fold lines and the fourth and sixth fold lines respectively;

tucking in the section of wrapping material defined by the second fold line and disposed between the third and fifth fold lines and the fourth and sixth fold lines respectively;

activating the activatable sealing adhesive member proximate to the first edge, folding the first edge over the wrapping material disposed along the wall of the gift box to confront and bind to underlying wrapping material; and activating the activatable sealing adhesive member proximate to the second edge, folding the second edge over the wrapping material disposed along the wall of the gift box to confront and bind to underlying wrapping material.

* * * * *